US005930911A

United States Patent [19]

Alward

[11] Patent Number: 5,930,911

[45] Date of Patent: Aug. 3, 1999

[54] MOBILE PAINT DRYER

[76] Inventor: Ray Alward, 8531 Ellsworth Rd., Ellsworth, Mich. 49729

[21] Appl. No.: 09/026,145

[22] Filed: Feb. 19, 1998

[51] Int. Cl.[6] ..... F26B 19/00

[52] U.S. Cl. ..... 34/90; 34/666

[58] Field of Search ..... 34/270, 90, 218, 34/225, 239, 666; 15/53.1, 53.3, DIG. 2; 134/123; D32/5, 17

[56] References Cited

U.S. PATENT DOCUMENTS

| | | | |
|---|---|---|---|
| 2,273,502 | 2/1942 | Couse | 34/666 |
| 4,038,760 | 8/1977 | Monck et al. | 34/109 |
| 4,534,119 | 8/1985 | Cabus et al. | 34/86 X |
| 4,771,552 | 9/1988 | Morioka | 34/229 X |
| 5,113,600 | 5/1992 | Telchuk | 34/90 |
| 5,130,173 | 7/1992 | Barten et al. | 427/314 |
| 5,216,774 | 6/1993 | Hill et al. | 15/53.2 |
| 5,661,912 | 9/1997 | Bhatnager et al. | 34/666 X |
| 5,735,062 | 4/1998 | Sukup | 34/580 X |

*Primary Examiner*—Henry Bennett
*Assistant Examiner*—Steve Gravini

[57] ABSTRACT

A mobile paint dryer is provided including a wheeled trailer. Also included is a heater unit mounted to the trailer for blowing heated air through the interior space of the trailer for drying paint on various entities removably situated therein.

12 Claims, 3 Drawing Sheets

MOBILE PAINT DRYER

BACKGROUND OF THE INVENTION

1. Field of the Invention

The present invention relates to stationary dryers and more particularly pertains to a new mobile paint dryer for drying paint on various structures including doors at remote locations.

2. Description of the Prior Art

The use of stationary dryers is known in the prior art. More specifically, stationary dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art stationary dryers include U.S. Pat. No. 4,771,552; U.S. Pat. No. 5,113,600; U.S. Pat. No. 4,872,270; U.S. Pat. No. 5,378,266; U.S. Pat. No. 5,130,173; and U.S. Pat. Des. No. 347,914.

In these respects, the mobile paint dryer according to the present invention substantially departs from the conventional concepts and designs of the prior art, and in so doing provides an apparatus primarily developed for the purpose of drying paint on various structures including doors at remote locations.

SUMMARY OF THE INVENTION

In view of the foregoing disadvantages inherent in the known types of stationary dryers now present in the prior art, the present invention provides a new mobile paint dryer construction wherein the same can be utilized for drying paint on various structures including doors at remote locations.

The general purpose of the present invention, which will be described subsequently in greater detail, is to provide a new mobile paint dryer apparatus and method which has many of the advantages of the stationary dryers mentioned heretofore and many novel features that result in a new mobile paint dryer which is not anticipated, rendered obvious, suggested, or even implied by any of the prior art stationary dryers, either alone or in any combination thereof.

To attain this, the present invention generally comprises a trailer having a rectangular configuration. As shown in the various Figures, the trailer is equipped with a top face, a bottom face, an open rear face, a front face and a pair of side faces formed therebetween. Such faces define an interior space. The open rear face has a pair of doors hingably coupled about vertical axes to opposite side faces. The doors thus allow the selective closing of the open rear face. An interior surface of the top face of the trailer has a plurality of parallel elongated rails coupled thereto and extending along a length of the trailer. Such rails define a plurality of slots for slidably receiving vertically oriented doors therein. The trailer includes two pairs of primary wheels mounted on the bottom face. An auxiliary wheel is mounted to a trailer hitch coupled to the front face and extended forwardly therefrom. Situated within a compartment formed in one of the side faces is a painting unit. The painting unit is equipped with an associated door for containing the same. The painting unit further includes an elongated hose from which spray paint is dispensed. Associated therewith is a heater unit mounted to the trailer for blowing heated air through the interior space of the trailer and through a pair of vents formed in the front face of the trailer. Next provided is a pair of tool compartments each including a recess formed in an associated one of the side faces adjacent to the open rear face. Each tool compartment includes a planar rectangular lid hingably coupled along a lower edge thereof. As such, the lid is adapted for pivoting between a closed vertical orientation and open horizontal orientation. As shown in FIGS. 1 & 4, a pair of rear compartments are formed within the interior space of the trailer and are each situated adjacent to an associated one of the side faces thereof. The rear compartments are accessed by way of the open rear face only when the associated doors are opened. Various accessories are included for facilitating work at a remote site. For allowing communication between various remote users, a citizen band radio is situated within one of the tool compartments. Also included is a radio having a pair of speakers each situated within an associated one of the rear compartments and facing rearwardly for emitting audible sounds therefrom. A refrigerator is positioned within a compartment formed in one of the side faces opposite the painting unit with an associated door for containing the same. Finally, a pair of booms each include a vertical post coupled to the top face of the trailer adjacent to both the rear face and a corresponding one of the side faces. An elongated horizontal rod is equipped with a length approximately equal to that of the trailer. An inboard end of the horizontal rod is rotatably coupled to a lower end of the vertical post about a vertical axis. A clamping assembly is coupled to an outboard end of the horizontal rod for supporting a door in an elevated position during painting. For further supporting the door, a support cable is provided with a first end coupled to an upper end of the vertical post and a second end coupled to the outboard end of the horizontal rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mobile paint dryer apparatus and method which has many of the advantages of the stationary dryers mentioned heretofore and many novel features that result in a new mobile paint dryer which is not anticipated, rendered obvious, suggested, or even implied by any of the prior art stationary dryers, either alone or in any combination thereof.

It is another object of the present invention to provide a new mobile paint dryer which may be easily and efficiently manufactured and marketed.

It is a further object of the present invention to provide a new mobile paint dryer which is of a durable and reliable construction.

An even further object of the present invention is to provide a new mobile paint dryer which is susceptible of a low cost of manufacture with regard to both materials and labor, and which accordingly is then susceptible of low prices of sale to the consuming public, thereby making such mobile paint dryer economically available to the buying public.

Still yet another object of the present invention is to provide a new mobile paint dryer which provides in the apparatuses and methods of the prior art some of the advantages thereof, while simultaneously overcoming some of the disadvantages normally associated therewith.

Still another object of the present invention is to provide a new mobile paint dryer for drying paint on various structures including doors at remote locations.

Even still another object of the present invention is to provide a new mobile paint dryer that includes a wheeled trailer. Also included is a heater unit mounted to the trailer for blowing heated air through the interior space of the trailer for drying paint on various entities removably situated therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
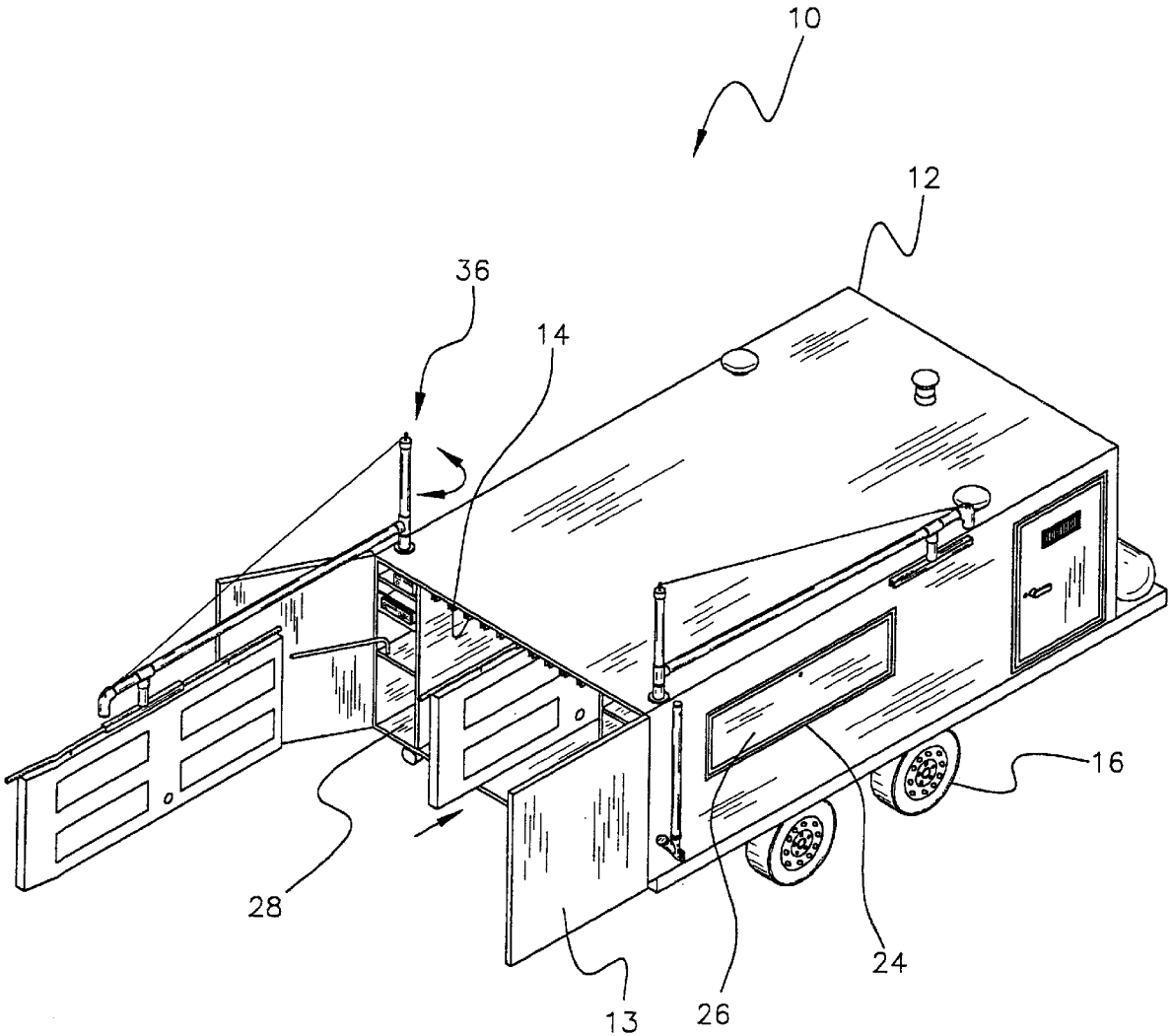
FIG. 1 is a rear perspective view of a new mobile paint dryer according to the present invention.
Figure 2:
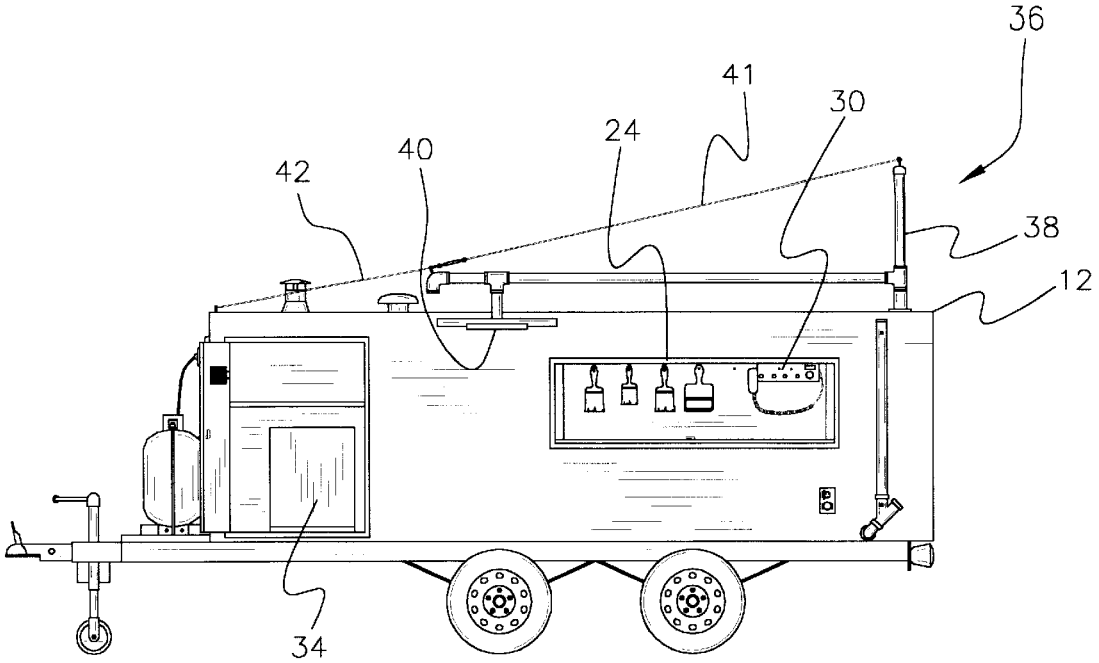
FIG. 2 is a first side view of the present invention.
Figure 3:
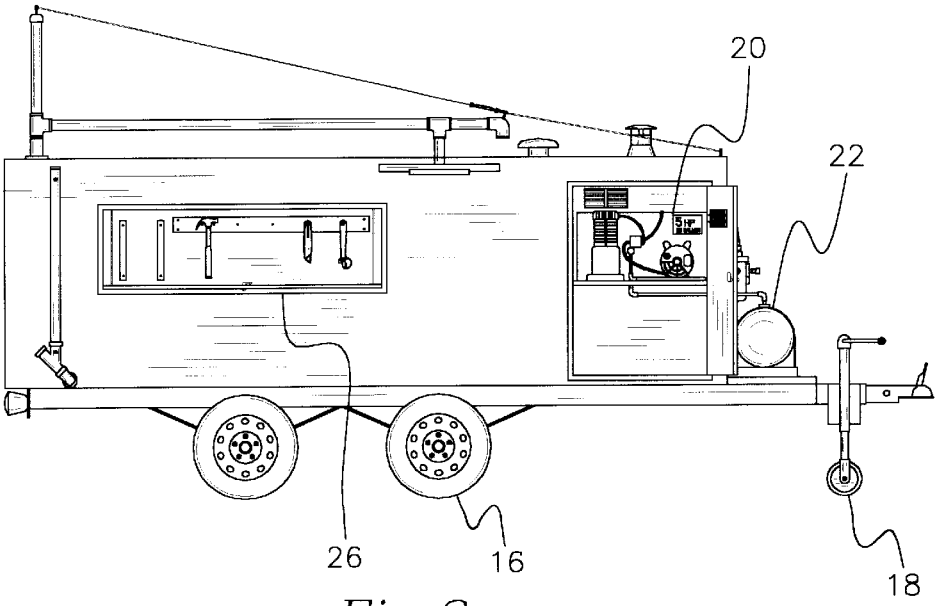
FIG. 3 is a second side view of the present invention.

With reference now to the drawings, and in particular to FIGS. 1 through 5 thereof, a new mobile paint dryer embodying the principles and concepts of the present invention and generally designated by the reference numeral 10 will be described.

The present invention, designated as numeral 10, includes a trailer 12 having a rectangular configuration. As shown in the various Figures, the trailer is equipped with a top face, a bottom face, an open rear face, a front face and a pair of side faces formed therebetween. Such faces define an interior space. The open rear face has a pair of doors 13 hingably coupled about vertical axes to opposite side faces. The doors thus allow the selective closing of the open rear face.

An interior surface of the top face of the trailer has a plurality of parallel elongated rails 14 coupled thereto and extending along a length of the trailer. Such rails define a plurality of slots for slidably receiving vertically oriented doors therein. The trailer includes two pairs of primary wheels 16 each having a separate axle mounted on the bottom face. An auxiliary wheel 18 is mounted to a trailer hitch coupled to the front face and extended forwardly therefrom. The trailer is preferably equipped with various traffic lights.

Situated within a compartment formed in one of the side faces is a painting unit 20. The painting unit is equipped with an associated door for containing the same. The painting unit further includes an elongated hose from which spray paint is dispensed. Associated therewith is a propane powered heater unit 22 mounted to the trailer for blowing heated air through the interior space of the trailer and through a pair of vents formed in the front face of the trailer. Ideally, a 50 Watt blower is employed to accomplish this.

Next provided is a pair of tool compartments 24 each including a recess formed in an associated one of the side faces of the trailer adjacent to the open rear face. Each tool compartment includes a planar rectangular lid 26 hingably coupled along a lower edge thereof. As such, the lid is adapted for pivoting between a closed vertical orientation and open horizontal orientation.

Figure 4:
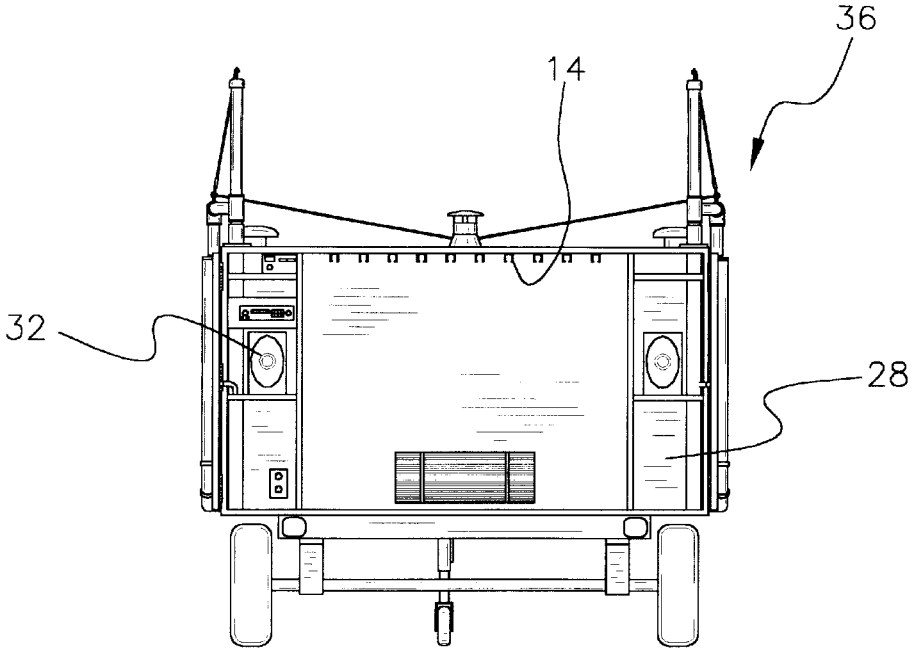
FIG. 4 is a rear view of the present invention.
Figure 5:
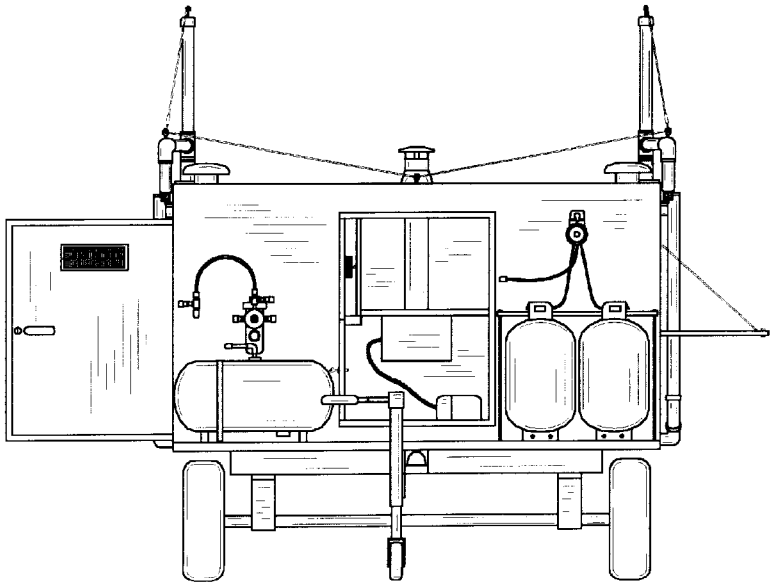
FIG. 5 is a front view of the present invention.

As shown in FIGS. 1 & 4, a pair of rear compartments 28 are formed within the interior space of the trailer and are each situated adjacent to an associated one of the side faces thereof. The rear compartments are accessed by way of the open rear face only when the associated doors are opened. It should be noted that the rear compartments each have a width equal to less than ¼ that of the trailer and height equal to that of the trailer. Further, inner side faces which define the rear compartments extend along an entire length of the trailer and further define inner side faces of the remaining aforementioned compartments of the present invention.

Various accessories are included for facilitating work at a remote site. For allowing communication between various remote users, a citizen band radio 30 is situated within one of the tool compartments. Also included is a radio having a pair of speakers 32 each situated within an associated one of the rear compartments and facing rearwardly for emitting audible sounds therefrom. A refrigerator 34 is positioned within a compartment formed in one of the side faces opposite the painting unit with an associated door for containing the same. A subcompartment is preferably situated above the refrigerator for storing various items. A further options includes an electrical outlet like that shown in FIG. 2.

Finally, a pair of booms 36 each include a vertical post 38 coupled to the top face of the trailer adjacent to both the rear face and a corresponding one of the side faces. An elongated horizontal rod is equipped with a length approximately equal to that of the trailer. An inboard end of the horizontal rod is rotatably coupled to a lower end of the vertical post about a vertical axis.

A clamping assembly 40 is slidably coupled to an outboard end of the horizontal rod for supporting a door in an elevated position during painting. The clamping assembly preferably includes a horizontally oriented groove which is adapted to resiliently clamp an elongated dowel which in turn may be temporarily coupled to an inboard edge of a door via a plurality of nails or the like.

For further supporting the door, a support cable 41 is provided with a first end coupled to an upper end of the vertical post and a second end coupled to the outboard end of the horizontal rod. So that the booms do not move inadvertently when not in use, a pair of securement cables 42 are removably coupled between the outboard end of the horizontal rods and the trailer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile paint dryer comprising, in combination:

a trailer having a rectangular configuration with a top face, a bottom face, an open rear face, a front face and a pair of side faces formed therebetween defining an interior space, the open rear face having a pair of doors hingably coupled about vertical axes to opposite side faces thereby allowing the selective closing of the open rear face, an interior surface of the top face having a plurality of parallel elongated rails coupled thereto and extending along a length of the trailer for defining a plurality of slots for slidably receiving vertically oriented doors therein, the trailer including two pairs of primary wheels mounted on the bottom face and an auxiliary wheel mounted to a trailer hitch coupled to the front face and extending forwardly therefrom;

a painting unit situated within a compartment formed in one of the side faces with an associated door for containing the same, the painting unit including an elongated hose from which spray paint is dispensed;

a heater unit mounted to the trailer for blowing heated air through the interior space of the trailer and through a pair of vents formed in the front face of the trailer;

a pair of tool compartments each including a recess formed in an associated one of the side faces adjacent to the open rear face, each tool compartment including a planar rectangular lid hingably coupled along a lower edge thereof for pivoting between a closed vertical orientation and open horizontal orientation;

a pair of rear compartments formed within the interior space of the trailer and each situated adjacent to an associated one of the side faces thereof, wherein the rear compartments are accessed by way of the open rear face;

a citizen band radio situated within one of the tool compartments for allowing communication between various remote users;

a radio including a pair of speakers each situated within an associated one of the rear compartments and facing rearwardly for emitting audible sounds therefrom;

a refrigerator positioned within a compartment formed in one of the side faces opposite the painting unit with an associated door for containing the same; and a pair of booms each including a vertical post coupled to the top face of the trailer adjacent to both the rear face and a corresponding one of the side faces and extending upwardly therefrom, an elongated horizontal rod with a length approximately equal to that of the trailer and an inboard end rotatably coupled to a lower end of the vertical post about a vertical axis, a clamping assembly coupled to an outboard end of the horizontal rod for supporting a door in an elevated position during painting, and a support cable with a first end coupled to an upper end of the vertical post and a second end coupled to the outboard end of the horizontal rod.

2. A mobile paint dryer comprising:

a trailer; and a heater unit mounted on the trailer for blowing heated air through an interior space of the trailer for drying paint on various entities removably situated therein.

3. A mobile paint dryer as set forth in claim 2 wherein a painting unit is situated on the trailer, the painting unit including an elongated hose from which spray paint is dispensed.

4. A mobile paint dryer as set forth in claim 2 wherein at least one tool compartment is situated on the trailer with a lid hingably coupled to the trailer for pivoting between a closed orientation and open orientation.

5. A mobile paint dryer as set forth in claim 2 wherein a pair of rear compartments are formed within an interior space of the trailer and each situated adjacent to an associated side faces thereof, wherein the rear compartments are accessed by way of an open rear face of the trailer.

6. A mobile paint dryer as set forth in claim 2 and further including a citizen band radio situated within the trailer for allowing communication between various remote users.

7. A mobile paint dryer as set forth in claim 2 and further including a radio situated within the trailer for emitting audible sounds.

8. A mobile paint dryer as set forth in claim 2 and further including a refrigerator positioned within a compartment formed in the trailer.

9. A mobile paint dryer as set forth in claim 2 and further including at least one boom mounted on the trailer for supporting an entity with a wet paint.

10. A mobile paint dryer as set forth in claim 9 wherein the boom is pivotable about a vertical axis.

11. A mobile paint dryer as set forth in claim 9 wherein the boom is pivotally coupled to a top face of the trailer.

12. A mobile paint dryer as set forth in claim 9 wherein the boom is pivotally coupled adjacent to an open rear face of the trailer.

* * * * *